US005386592A

United States Patent [19]

Checkeroski

[11] Patent Number: 5,386,592

[45] Date of Patent: Feb. 7, 1995

[54] HEADBAND AND FLASHLIGHT HOLDING CONSTRUCTION

[76] Inventor: Mark Checkeroski, 3423 Wedgewood Dr., Rochester Hills, Mich. 48306

[21] Appl. No.: 117,780

[22] Filed: Sep. 7, 1993

[51] Int. Cl.[6] ..... A42B 1/24

[52] U.S. Cl. ..... 2/209.13; 2/906; 2/918; 2/DIG. 11; 362/105

[58] Field of Search ..... 2/171, 171.1, 209.3, 2/209.4, 209.11, 209.13, 209.14, 419, 420, 906, 909, 918, DIG. 11; 362/105, 106, 107

[56] References Cited

U.S. PATENT DOCUMENTS

| | | | |
|---|---|---|---|
| D. 176,073 | 11/1955 | Mantell | 2/906 |
| 1,319,997 | 10/1919 | Galloway et al. | 2/195.5 |
| 2,428,937 | 10/1947 | Lazarus | 2/209.3 |
| 3,249,271 | 5/1966 | Allbritton | 362/105 |
| 4,406,040 | 9/1983 | Cannone . | |
| 4,744,106 | 5/1988 | Wang . | |
| 4,887,194 | 12/1989 | Fields . | |
| 5,053,932 | 10/1991 | Case . | |
| 5,117,510 | 6/1992 | Broussard et al. . | |
| 5,217,294 | 6/1993 | Liston | 362/105 |
| 5,253,368 | 10/1993 | Blake | 2/209.13 |

FOREIGN PATENT DOCUMENTS 2107039 4/1983 United Kingdom .

*Primary Examiner*—Clifford D. Crowder
*Assistant Examiner*—Diana L. Befeld
*Attorney, Agent, or Firm*—Dykema Gossett

[57] ABSTRACT

A headband and flashlight holding construction includes a plurality of equal length straps. Two of the straps are joined together to form a headband, and two of the straps are orthogonally joined to the headband forming semi-loops so that, when the headband is situated on a user's head, the semi-loops span across the cranium of the user. The straps have loop-type material surfaces. At least the two straps that span across the cranium of the user, when in used have the loop-type material surfaces radially outermost. Holding devices are secured to small flashlights. These holding devices have hook-type material situated radially outwardly. Thus, the flashlight may be joined to the cranium spanning straps by simply pressing the holding devices against the straps allowing the hook-type material to intermesh with the loop-type material. Hook-type material fasteners are used to join the remaining two straps to form a full loop for the headband. These fasteners are also situated, by virtue of their length, to join the headband to the cranium spanning straps.

12 Claims, 1 Drawing Sheet

HEADBAND AND FLASHLIGHT HOLDING CONSTRUCTION

BACKGROUND OF THE INVENTION

I. Field of the Invention

The present invention relates to the combination of a headband and flashlight holding construction. More particularly, the present invention relates to the combination of a headband and holding construction, whereby one or a number of implements, including flashlights, may be detachably held on the headband and holding construction. Still more particularly, the present invention relates to a headband construction to which one or more flashlight holding devices may be easily attached and detached and which allows the user to position a flashlight secured to the flashlight holding device to furnish light in the direction of the eyes of the user. Even still more particularly, the present invention relates to a headband and flashlight holding construction that includes a headband having exposed surfaces of loop-type material to which one or more flashlight holding devices fasten, each of which flashlight holding devices has exposed surfaces of a hook-type material.

II. General Background

There are many tasks for which the performer of the task needs to direct light, particularly narrowly focused light. Examples are many, but those that come to mind are the tasks associated with working on an automobile engine, hunting or fishing at night, and performing medical operations. There are a number of small pocket penlights or flashlights, typically using one or two AA or AAA size batteries, that are convenient for their size and lightweight and for their narrowly focused light. But for the tasks just mentioned, the user is inconvenienced by having to hold even a small penlight or flashlight.

Miners who work in dark mines have long known of using headlamps to focus light upon their tasks. Headlamps, however, are bulky and are not easily carried about or stored when not in use. Thus, there is a need for a simple construction that would support a small headlamp and that would be easily carried about or stored when not in use.

SUMMARY OF THE PRESENT INVENTION

The present invention is a headband and flashlight holding construction that includes a headband, two straps forming semi-loops orthogonally extending from the headband, and holding devices, preferably, for small flashlights or penlights, but for other implements as well. The two semi-looped straps are attached to the headband, and as worn on a human head, the straps extend from the headband on one side of the head over the cranium and then back down to the headband, to join thereto. The construction can be adapted to fit over a cap or the like.

The headband may be one continuous strap encircling the head or crown of a cap, with the ends of the strap generally joined together. This joinder of ends is facilitated by the material structure of the headband and at least one fastener. The fastener has first and second surfaces of a hook-type material. The headband has at least one surface of a loop-type material, preferably worn radially inwardly of the headband-although, as will be mentioned, the loop-type material surface may be worn radially outwardly for a certain advantage. Cooperating with the loop-type material structure of the headband, a fastener may be joined to one end of a strap forming the headband by the the hook-type material of the fastener intermeshing with the loop-type material of the headband, in the manner of fasteners sold under the VELCRO trademark. The fastener likewise may be joined to the other end of a strap forming the headband. The fastener allows the headband to be adjustable, depending on the length of the fastener and thereby its facility to join one end of the headband strap to a remote other end with the fastener spanning the distance between ends to complete a circle.

A fastener may also join the straps, which are worn over the cranium or cap crown, to the headband. When the headband is worn with its loop-type material surface radially inwardly and the fastener joined to the headband, the fastener's hook-type material surface, which is opposite the surface intermeshed with the headband, is presented radially inwardly to intermesh with the loop-type surface of a strap. Another fastener, situated on the headband diametrically opposite the first-mentioned fastener, may be available for attachment of the strap in the manner already described.

Preferably, the straps are of a predetermined length. Moreover, it is preferable that headband be made of at least two straps of the predetermined length joined together by two fasteners disposed on the headband diametrically opposite of one another.

A flashlight holding device is secured to a flashlight, preferably encircling it. The flashlight holding device also has a surface of a desired material construction. This latter surface is preferable of a hook-type material, like that of the fastener, which may intermesh with the loop-type material surfaces of the straps that orthogonally intersect the headband-those straps worn over the cranium or cap crown with the loop-type surface radially outwardly. The holding device may be situated at any point along the semicircumference of these straps. The headband may be reversed or tucked inside out, so that the loop-type material of headband is radially outwardly of the headband (with the fastener or fasteners disposed radially outwardly of headband's loop). With the loop-type material surface of headband so disposed, the hook-type material surface of the flashlight holder or holder may intermesh with the loop-type material of headband so that the holding device may be situated at any point along the circumference of headband.

Preferably, the headband and flashlight holding construction is made of four straps, two fasteners, and two holding devices per flashlight. The holding devices are looped around one or more flashlights. Preferably, two holding devices may be permanently secured to each flashlight used in conjunction with the invention, by glue or other means.

Although the headband and flashlight holding construction of the present invention has particular use in holding flashlights, the invention may be used to hold other implements whereby the holding device may be secured to the implement as a strap attached thereto, including encircling the implement or depending therefrom. For a further understanding of the nature and objects of the present invention, reference should be had to the following detailed description taken in conjunction with the accompanying drawings, in which like parts are given like reference numerals.

DETAILED DESCRIPTION OF THE PREFERRED EMBODIMENT

Figure 1:
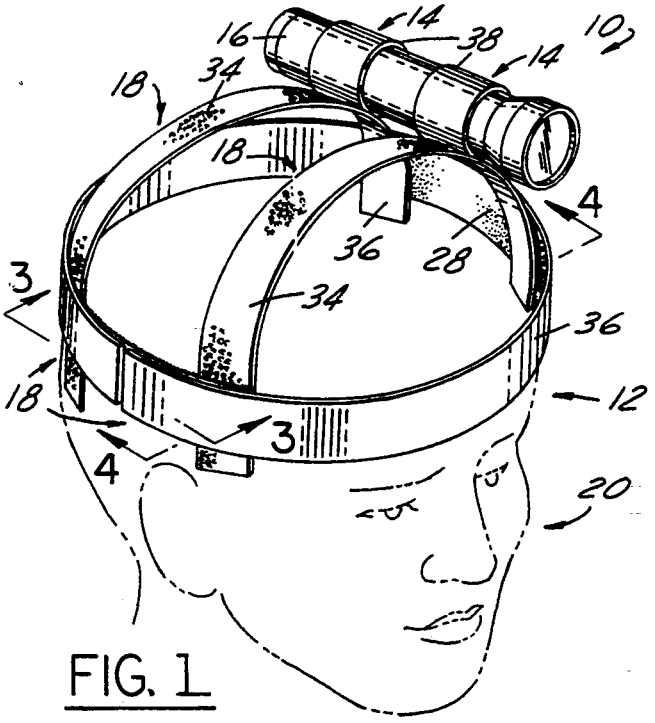
FIG. 1 is a perspective view of the preferred embodiment of the headband and flashlight holding construction of the present invention, showing its disposition with respect to a human head, which is shown in phantom.
Figure 2:
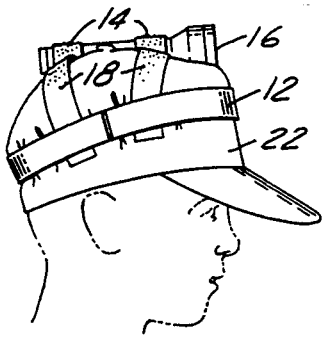
FIG. 2 is a side elevational view of the preferred embodiment of the present invention shown in use.

Referring first to FIG. 1, the preferred embodiment of the headband and flashlight holding construction is generally designated by the numeral 10. The headband and flashlight holding construction 10 includes both the headband 12 and at least one flashlight holding device 14, two such devices 14 being shown in FIG. 1. The holding devices 14 hold a small flashlight 16. Attached to the headband 12 are two semi-looped cross straps 18. As worn on a human head 20, shown in phantom, cross straps 18 extend from the headband 12 on one side of the head 20 over the cranium and then back down to the headband 12, to join thereto. In FIG. 2 and also in FIG. 5, it is seen that the construction shown in FIG. 1, can be adapted to fit over a cap 22 or the like.

Figure 3:
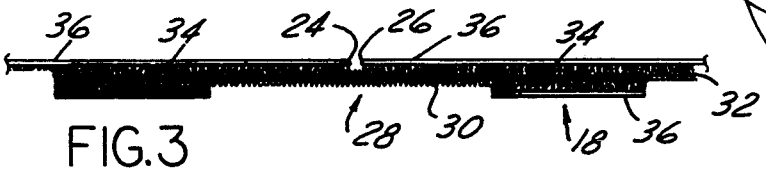
FIG. 3 is a partial cross-sectional view of the present invention taken generally in the direction of arrows 3—3 of FIG. 1.

Referring now to both FIGS. 1 and 2 and, in addition, FIG. 3, it may be seen that headband 12 may be one continuous strap encircling the head 20 or crown of a cap 22. Ends 24 and 26 are generally joined together. This joinder ends 24 and 26, here shown generally as abutting ends 24 and 26, is facilitated by the material structure of headband 12 and a fastener 28.

Fastener 28 has first (outer) and second surfaces 30 and 32, respectively. The outer and inner surfaces 30 and 32 of fastener 28 are of a hook-type material. Headband 12 also has first (inner) and second (outer) surfaces 34 and 36, respectively. Inner surface 34 is of a loop-type material. Outer surface 36 may be a smooth, tightly weaved material surface, as backing for the loop-type material, but it may also be of a loop-type material. The hook-type material and the loop-type material may be joined together with the hook-type material intermeshing with the loop-type material in the manner of fasteners sold under the VELCRO trademark.

Accordingly, fastener 28, which has hook-type outer and inner surfaces 30 and 32 on respective sides of fastener 28, may intermesh on the inner surface 32 with the loop-type surfaces 34 of headband 12 to adjustably join ends 24 and 26. The adjustment may be made by virtue of the length of fastener 28. Thus, ends 24 and 26 may be drawn closer together or spaced further apart than shown in FIG. 3 so as to lengthen the circumference of headband 12.

Figure 4:
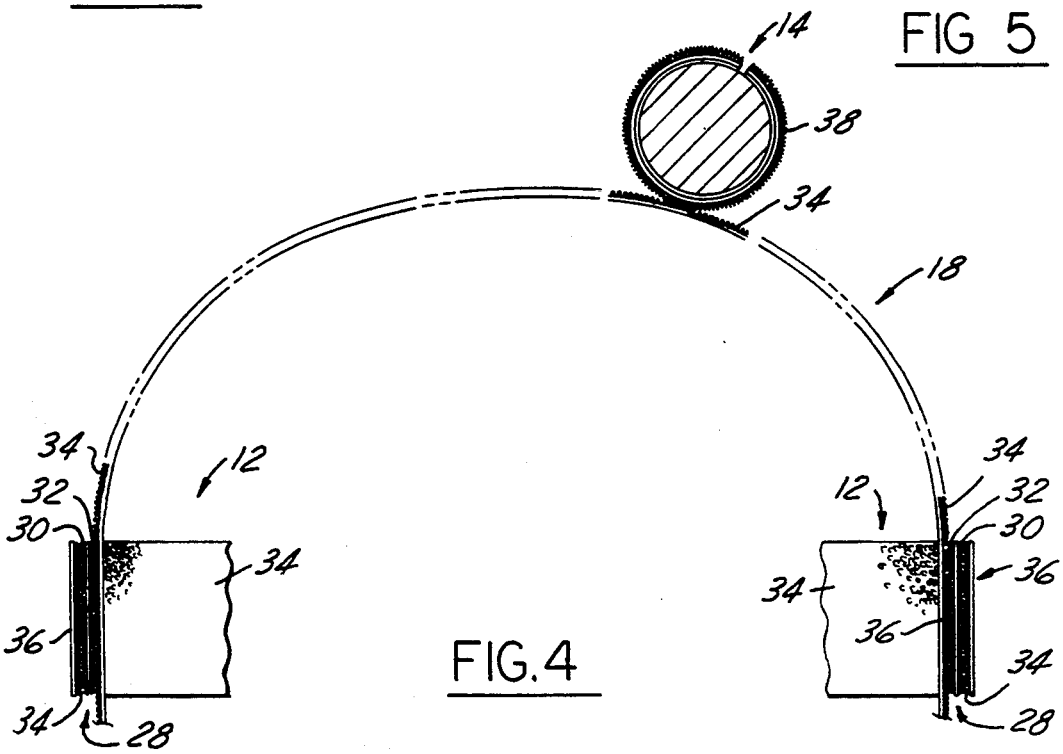
FIG. 4 is a cross-sectional view taken generally in the direction of arrows 4—4 of FIG. 1.

As can be seen in FIG. 4, cross strap 18 may be joined to the opposite or outer surface 30 of fastener 28 to secure cross strap 18 to headband 12. Preferably, cross straps 18 are of a predetermined length. Moreover, it is preferable that headband 12 be made of at least two straps 18 of the predetermined length (a front strap and a rear strap) joined together by fastener 28. Headband 12 may be made even larger by adding additional straps, although the position of fasteners 28 in the construction as shown provide for anchorage of cross straps 18, which intersect the headband 12 generally orthogonally, and which are spaced apart generally the length of a fastener 28, as can be seen in FIG. 3.

With references to FIGS. 1–4, it can be seen that the flashlight holding device 14 also has a surface 38 of a desired material construction. Surface 38 is thus of a hook-type material which may intermesh with the loop-type material surfaces 34 of cross straps 18 which orthogonally intersect headband 12. Accordingly, holding device 14 may be situated at any point along the semicircumference of cross strap 18. As two holding devices 14 may be positioned on flashlight 16, flashlight 16 may be angled across straps 18 at any angle desired. The flashlight 16 may be taken off or placed back on cross straps 18 and located on straps 18 as desired. Preferably, when two holding devices 14 are used, they are positioned so that each one coincides with a cross strap 18 that intersects orthogonally with headband 12, which is generally constrained by the length of fastener 28. It is to be appreciated, however, that other cross straps 18 may be added to the headband and flashlight holding construction 10. Additionally, in the same manner as cross straps 18 may be added to the headband 12 to extend from the headband 12 on one side of the head 20 over the cranium and then back down to the headband 12, to join thereto, a single strap may be added to extend from the headband 12 on one side of the head at the temple area down under the chin and then back up to the headband 12 to provide a chin straps which is particularly advantageous when a cap 22 is worn under the headband and flashlight holding construction 10 during windy conditions.

It is also to be appreciated that the headband 12 may be reversed or tucked inside out, even with the cross straps 18 that orthogonally intercept headband 12 attached, so that the loop-type material of headband 12 is radially outwardly of headband 12 (unless the loop-type material is on both surfaces of the headband 12). Fastener 28 now would be disposed radially outwardly of headband's 12 loop. With the loop-type material surface 34 of headband 12 so disposed, the hook-type material surface 38 of holder or holders 14 may intermesh with the loop-type material of headband 12, so that holding devices 14 may be situated at points along the circumference of headband 12.

The headband and flashlight holding construction 10 of the present invention has been shown and described as a preferred embodiment having a particular use in holding flashlights, but the invention may be used to hold other implements whereby the holding device may be secured to the implement as a strap attached thereto, including encircling the implement, as holding device 14 encircles a flashlight 16, or depending therefrom, such as a strap or square attached to the implement.

Figure 5:
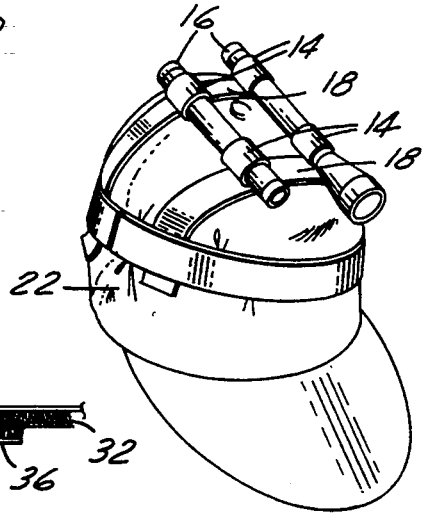
FIG. 5 is a perspective view of the present invention utilizing two penlights or small flashlights.

Preferably, the headband and flashlight holding construction 10 is made of four straps 18, two fasteners 28, and two holding devices per flashlight. As can be seen in FIG. 5, more than one flashlight may be used at a time. The fasteners function to Join together two of the strap 18 to form a headband and two other straps to intersect orthogonally with the headband in a semi-loop for use across the cranium of a user 20 or the crown of a cap 22. The holding devices 14 are looped around one or more flashlights 16. Preferably, two holding devices 14 may be permanently secured to each flashlight used in conjunction with the invention, by glue or other means. Hook- or loop-type material sold under the VELCRO trademark is available with adhesive backing, so that strips of the material may be joined adhesive backing to adhesive backing to fashion a fastener 28. Strips of material may be secured to a flashlight 16 for a holding device 24 by the adhesive backing adhering to the flashlight 16. Accordingly, the invention provides the user with a structure that is easily collapsible and that will fit into a pocket as a penlight may be stored away in the manner of storing away such small devices. As VELCRO brand fastening devices may be made of nylon, the material may be easily stored and is washable.

It is further contemplated that the headband and flashlight holding construction 10 may be modified to include the headband 12 and one or more semi-looped straps 18 which extends from the front of the headband 12 to the rear of the headband 12 rather than from ear to ear as shown in FIG. 1. In other words, the semi-looped strap(s) extends from the nose of the wearer to the back of the head.

It is also contemplated that a plurality of cross straps 18 may be used which are perpendicular or at an angle to one another in order to support heavier flashlights or other objects such as small portable radios, small plastic boxes for fishing tackle etc. In such cases, the straps would extend from front to back and from ear to ear.

If the object to be attached uses loop fastener, then the band has hook fastener exposure. If the object has attached hook material than the band has exposed loop material.

Because of the many varying and different embodiments that may be made within the scope of the inventive concept taught by the present invention, and because many modifications may be made to the embodiments just described, it is to be understood that the details of this description are to be interpreted as a illustrative and not in a limiting sense.

I claim:

1. An apparatus for holding and supporting a flashlight and worn on the head of the wearer, with the flashlight oriented to project a light beam in a forward direction, generally in the direction the wearer is facing comprising:

an adjustable headband for encircling the head of the wearer and having front and back interconnected head straps, said head straps having inner and outer surfaces, the inner surfaces of said front and back head straps being provided with loop-type material, said front and back head straps having end portions, with the end portions on said front head strap being spaced from the end portions on said back head strap;

a pair of fasteners for adjustably connecting said spaced apart end portions of said head straps together, said fasteners having inner and outer surfaces which are provided with hook-type material, the outer hook-type material of said fasteners engaging the loop-type material provided on said front and back head straps, said fasteners being located at the sides of the head of the wearer;

a plurality of spaced apart cross straps, each cross strap having a pair of ends and extending across the head of the wearer from one side of the head to the other side, said cross straps having upper and lower surfaces, with the upper surfaces of said cross straps having loop-type material extending between said ends and intermeshed with the hook-type material provided on the inner surfaces of said fasteners; and a pair of removable flashlight holding devices, one for each cross strap, each flashlight holding device having an exterior surface provided with hook-type material for intermeshing with the loop-type material provided on the upper surface of the corresponding cross strap to hold a flashlight in a removably fixed position on the head of the wearer of the apparatus.

2. The apparatus of claim 1, wherein said front and back head straps and said plurality of cross straps are of generally equal length.

3. The apparatus of claim 2, wherein said fasteners are of generally equal length.

4. The apparatus of claim 2, wherein there are a pair of cross straps.

5. The apparatus of claim 1, wherein said straps are made from nylon material.

6. The apparatus of claim 1, wherein said headband is adjusted by removing the fasteners, changing the spacing between the opposite end portions of said front and back head straps and thereafter maintaining the new spacing by meshing the hook-type material on the pair of fasteners with the loop-type material on the head straps.

7. The apparatus of claim 1, wherein said flashlight holding devices are adhered to a flashlight.

8. The apparatus of claim 1, wherein there are a second pair of removable flashlight holding devices, one on each cross strap, for carrying a second flashlight on the cross straps.

9. The apparatus of claim 1, wherein said pair of removable flashlight holding devices may be located on any area of the upper surfaces of the cross straps between the end portions thereof.

10. The apparatus of claim 1, wherein said headband is of a size to fit over a hat worn by the wearer.

11. An apparatus for holding and supporting an implement and worn on the head of the wearer, comprising:

an adjustable headband for encircling the head of the wearer and having inner and outer surfaces, the inner surface of the headband being provided with hook and loop material, said headband having end portions, with one of the end portions being spaced from the other of said end portions;

a first fastener for adjustably connecting said spaced apart end portions of said headband together, said fastener having inner and outer surfaces which are provided with hook and loop material, the outer hook and loop material of said fastener engaging the hook and loop material provided on said headband, and a second fastener of generally the same construction as said first fastener being located on said headband directly opposite to said first fastener;

a plurality of spaced apart cross straps, each cross strap having a pair of ends and extending across the head of the wearer from one side of the head to the other side, said cross straps having upper and lower surfaces, with the upper surfaces of said cross straps having hook and loop material extending between said ends and intermeshed with the hook and loop material provided on the inner surfaces of said fasteners; and a pair of removable implement holding devices, one for each cross strap, each holding device having an exterior surface provided with hook and loop material for intermeshing with the hook and loop material provided on the upper surface of the corresponding cross strap to hold an implement in a removably fixed position on the head of the wearer of the apparatus.

12. An apparatus for holding and supporting an implement and worn on the head of the wearer, comprising:

an adjustable headband for encircling the head of the wearer and having front and back interconnected head straps, said head straps each having inner and outer surfaces, the inner surface of each head strap being provided with hook and loop material, said front and back head straps having end portions, with the end portions on the front head strap being spaced from the end portions on the back head strap;

a pair of fasteners for adjustably connecting said spaced apart end portions of said head straps together, said fasteners having inner and outer surfaces which are provided with hook and loop material, the outer hook and loop material of said fasteners engaging the hook and loop material provided on said front and back head straps, said fasteners being located at the sides of the head of the wearer;

a plurality of spaced apart cross straps, each cross strap having a pair of ends and extending across the head of the wearer from one side of the head to the other side, said cross straps having upper and lower surfaces, with the upper surfaces of said cross straps having hook and loop material extending between said ends and intermeshed with the hook and loop material provided on the inner surfaces of said fasteners; and a pair of removable implement holding devices, one for each cross strap, each holding device having an exterior surface provided with hook and loop material for intermeshing with the hook and loop material provided on the upper surface of the corresponding cross strap to hold an implement in a removably fixed position on the head of the wearer of the apparatus.

* * * * *